US007234891B2

(12) United States Patent
Niiya et al.

(10) Patent No.: US 7,234,891 B2
(45) Date of Patent: Jun. 26, 2007

(54) MULTI-LEVEL ROAD INTERSECTION

(75) Inventors: Futoshi Niiya, Kouchi-ken (JP); Hiroshi Niiya, Sukumo (JP); Tomizo Kuroishi, Sukumo (JP)

(73) Assignee: Tsukinada Kensetsu Kabushiki Kaisha (JP)

( * ) Notice: Subject to any disclaimer, the term of this patent is extended or adjusted under 35 U.S.C. 154(b) by 0 days.

(21) Appl. No.: 11/249,764

(22) Filed: Oct. 14, 2005

(65) Prior Publication Data

US 2007/0086855 A1 Apr. 19, 2007

(51) Int. Cl.
*E01C 1/00* (2006.01)

(52) U.S. Cl. ..... 404/1

(58) Field of Classification Search ..... 404/1
See application file for complete search history.

(56) References Cited

U.S. PATENT DOCUMENTS 1,689,161 A * 10/1928 Skultin ..... 404/1
2,941,454 A * 6/1960 Cedeno ..... 404/1
3,847,496 A * 11/1974 Stankiewicz ..... 404/1
4,272,210 A 6/1981 Shoji et al.
4,592,673 A * 6/1986 Lee ..... 404/1
6,685,386 B1 * 2/2004 Lee ..... 404/1

FOREIGN PATENT DOCUMENTS

JP 09-137409 5/1997
JP 2005-264581 * 9/2005

OTHER PUBLICATIONS

Map of intersection of Waterloo Road and Highway 100, Howard County, Maryland.*
Map of intersection of Snowden River Parkway and Highway 100, Howard County, Maryland.*

* cited by examiner

*Primary Examiner*—Gary S. Hartmann
(74) *Attorney, Agent, or Firm*—Bacon & Thomas, PLLC

(57) ABSTRACT

A multi-level road intersection comprises a continuous-flow overpass for handling through traffic traveling on a first road, a continuous-flow underpass for handling through traffic traveling on a second road, and a rotary disposed on a ground level at the crossing area for handling right turn, left turn and U-turn traffics. Change-direction and merge lanes are disposed on the ground level to enable right turn, left turn and U-turn traffics to deviate from the first or second road to enter into the rotary, and to outgo therefrom toward a desired direction. Barrier-free pedestrian walkways are disposed at grade on the ground level adjacent the outer periphery of the rotary to enable pedestrian traffic to traverse the first and/or second roads with ease and with minimum exposure to vehicular traffic.

12 Claims, 6 Drawing Sheets

MULTI-LEVEL ROAD INTERSECTION

BACKGROUND OF THE INVENTION

1. Field of the Invention

The present invention relates to a multi-level road intersection, with barrier free pedestrian walkways.

2. Description of the Prior Art

Multi-level cloverleaf interchanges are commonly used for highways and rural environment as they enable continuous traffic flow in all directions. However, the cost to build such cloverleaf interchanges, including the cost for land acquisition, is prohibitive in city environment. Furthermore, existing single-level city road intersections would not be modified and reformed into the large scale cloverleaf design because to rebuild the existing intersections is extremely difficult, if not impossible at all, in busy city streets where a substantially uninterrupted traffic flow must be maintained all the time.

Japanese Patent Kokai Publication No. 63-114701 proposes a three-level road intersection which is relatively small in scale and is therefore applicable to city environment. A first road is disposed on the ground level and is adapted to allow through traffic. A second road includes a continuous-flow overpass disposed at an elevated level above the first road to thereby permit through traffic along the second road. A rotary structure is disposed at a third level above the overpass of the second road and is connected to the first and second roads to handle right turn, left turn and U-turn traffics. Pedestrian walkways for enabling pedestrian traffic to traverse the roads are made in the form of tunnels disposed at the underground level. The problem of this intersection as used in the city environment where a substantial pedestrian traffic exists is that the pedestrian walkways in the form of underground tunnels are not user-friendly for elderly, handicapped and infantile pedestrians and often serve as barriers against wheeled chairs, baby buggies and bicycles.

SUMMARY OF THE INVENTION

Accordingly, an object of the present invention is to provide a road intersection which ensures continuous flow as far as possible but is small in scale to thereby permit use in city environment.

Another object of the invention is to provide a road intersection which is suitable to be built by reforming an existing single-level city road intersection.

A still another object of the invention is to provide a road intersection provided with pedestrian walkways which are easy to use and user friendly.

A further object of the invention is to provide a road intersection provided with barrier free pedestrian walkways.

This invention provides a three-level road intersection for first and second roads or streets intersecting with each other. According to the invention, the intersection includes a continuous-flow overpass for handling through traffic traveling on the first road and a continuous-flow underpass for handling through traffic traveling on the second road. A rotary for handling right turn, left turn and U-turn traffics is disposed at grade on the ground level at a crossing area in which the first and second roads are to intersect with each other. The first and second roads are provided with change-direction lanes disposed on the ground level alongside of respective roads to enable right turn, left turn and u-turn traffics to deviate from the first and second roads to enter into the rotary. Merge or outgo lanes are similarly disposed on the ground level and alongside of respective roads to enable traffic to get into an intended road lane after completing right turn, left turn or U-turn within the rotary.

Barrier-free pedestrian walkways are disposed at grade on the ground level adjacent the outer periphery of the rotary to enable pedestrian traffic to traverse the first and second roads. The pedestrian walkway for traversing the first road comprises pedestrian crossing portions which traverse at grade the change-direction lane and associated merge lane, respectively, of the first road and an intermediate portion which connects the crossing portions with each other and which is disposed on the ground level to pass underneath the overpass. On the other hand, the pedestrian walkway for traversing the second road comprises an intermediate connecting portion which is disposed on the ground level but extends over the underpass.

With this arrangement, pedestrian traffic, including wheeled chair, baby buggy, bicycle, is able to traverse the roads or streets without difficulties and with minimum exposure to vehicular traffic.

In another embodiment of the invention, change-direction and merge lanes of the first road are made upwardly convex to form raised central portions and the barrier-free pedestrian walkways for traversing the first road are arranged, respectively, to extend underneath the overpass and the raised central portions of the change-direction and merge lanes.

In a more simplified form of the invention, there is provided a two-level road intersection. The rotary for handling right turn, left turn and U-turn traffics is similarly disposed on the ground level at the crossing area. The first road is similarly made in the form of a continuous-flow overpass or underpass for handling through traffic. However, the second road remains running at grade on the ground level and is directly connected to the rotary. Barrier-free pedestrian walkways for traversing the first road are disposed on the ground level and are arranged to extend under the overpass or over the underpass.

In a further simplified form, the invention provides a T-shaped two-level road intersection comprising a first road to which a second road intersects in T. The first road also has a continuous-flow overpass or underpass for handling through traffic. The second road disposed on the ground level terminates at the rotary and is directly connected thereto. Barrier-free pedestrian walkways for traversing the first road are similarly disposed on the ground level to pass under the overpass or over the underpass.

These features and advantages of the invention as well as other features and advantages thereof will become apparent from the following description.

DESCRIPTION OF THE PREFERRED EMBODIMENTS

Figure 1A:
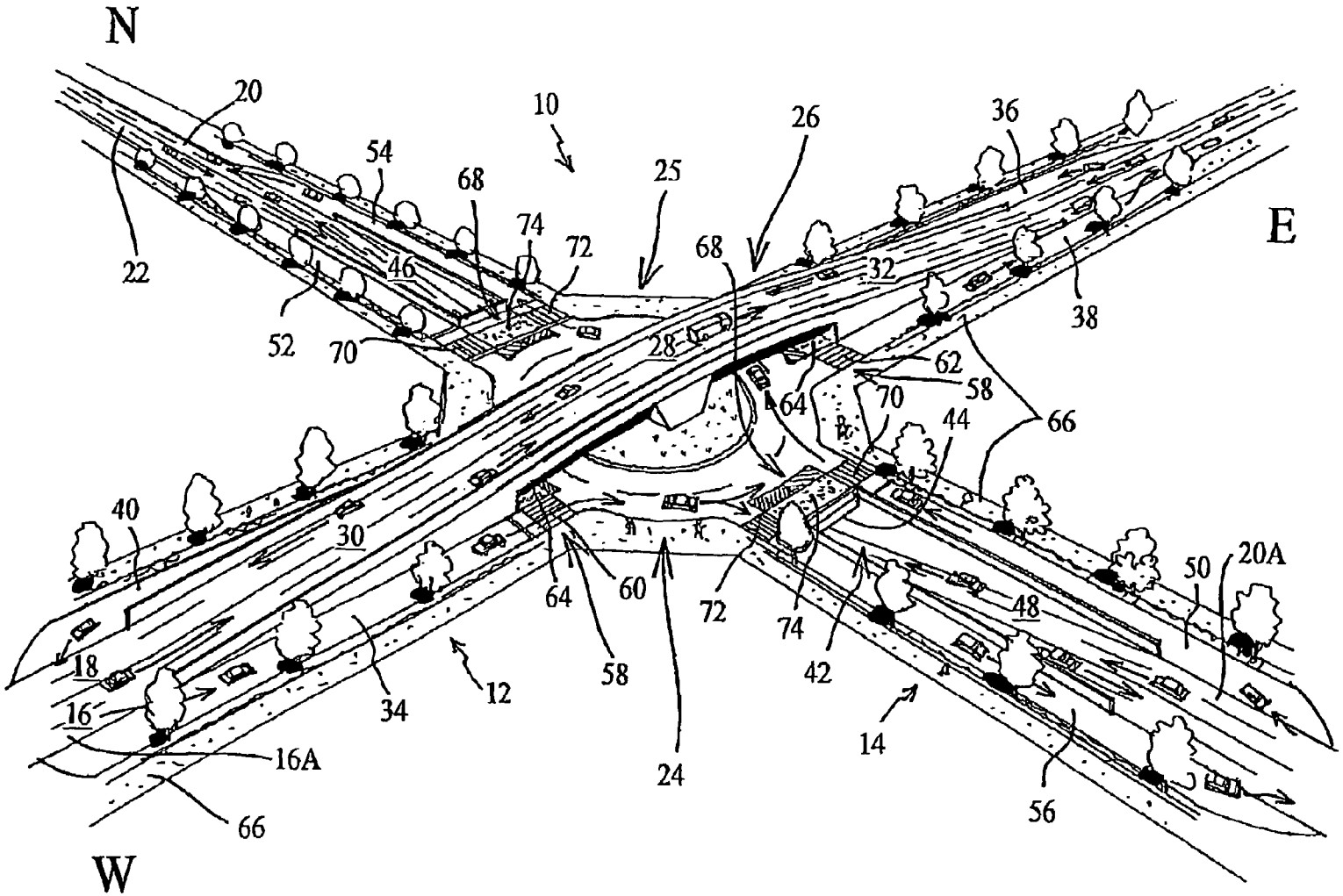
FIG. 1A is a perspective view of the three-level road intersection according to the first embodiment of the invention and FIG. 1B is a perspective view of the intersection shown in FIG. 1A but viewed from a different angle.
Figure 1B:
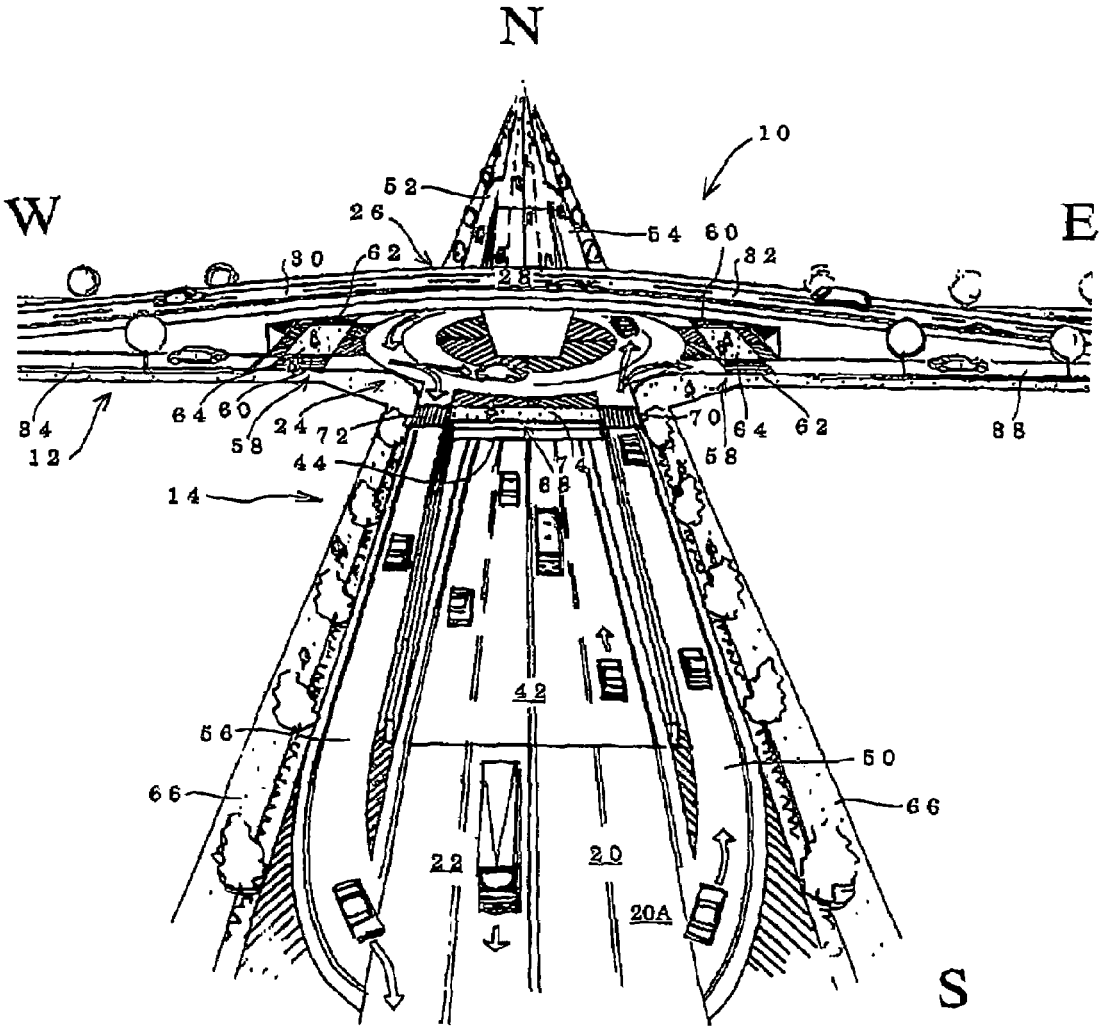

Referring now to FIGS. 1A and 1B, there is shown a three-level road intersection, provided with barrier-free pedestrian walkways, according to the invention. The intersection, indicated generally by the reference numeral 10, is comprised of two roads 12 and 14, indicated for convenience as running east-west and north-south, respectively. The east-west road 12 includes a plurality of forward or straight run lanes, for example, two eastbound lanes 16 and two westbound lanes 18. Similarly, the north-south road 14 may include, for example, two northbound lanes 20 and two southbound lanes 22. A one-way rotary structure 24 is formed at the crossing area 25 in which the roads 12 and 14 are to intersect with each other when viewed in the top plan view. The inner diameter of the rotary 24 is set large enough to enable long vehicles such as trailers to turn around without difficulties.

The east-west road 12 has a continuous flow overpass 26 for handling through traffic. The overpass 26 is comprised of a bridge 28 striding over the rotary 24 for a distance greater than the outer diameter of the rotary 24 and a pair of opposite ramps 30 and 32 sloping down from the bridge 28 and smoothly joined to the ground level sections of the road 12. To conform with the lanes 16 and 18, the overpass 26 is provided with two eastbound lanes and two westbound lanes so that the overpass 26 forms an integral part of the east-west road 12.

The outer lane 16A of the eastbound lanes 16 is provided with a change-direction lane (or right and left turn lane) 34 disposed on the ground level contiguous to or adjacent to the rotary 24 alongside of the outer lane 16A, to enable right turn traffic, left turn traffic and U-turn traffic to divert away from the outer lane 16A and to enter the rotary 24. The change-direction lane 34 is deviated at an incoming end thereof from the outer lane 16A beforehand of the overpass 26 as viewed in the direction of traffic travel and is merged at the other end with the rotary 24. Similarly, the outer lane of the westbound lanes 18 is provided with a change-direction lane 36 which is identical in structure and function with the lane 34.

The outer lane 16A of the eastbound lanes 16 is further provided with a merge or outgo lane 38 disposed on the ground level contiguous to the rotary 24 and alongside of the outer lane 16A. The merge lane 38 has a proximal end connected to the rotary 24 and an outgoing end merged with the outer lane 16A beyond the overpass 26 as viewed in the direction of traffic travel. The merge lane 38 enables traffic running on the rotary 24 to get into the outer lane 16A beyond the overpass 26 after completion of right turn, left turn or U-turn. Similarly, the outer lane of the westbound lanes 18 is provided with a merge lane 40 which is identical in structure and function with the merge lane 38.

On the other hand, the-north-south road 14 has a continuous flow underpass 42 for handling through traffic. The underpass 42 is comprised of a tunnel 44 passing underneath the rotary 24 and a pair of opposite ramps 46 and 48 in the form of open-channel trenches smoothly joined to the ground level sections of the north-south road 14. The underpass 42 is similarly provided with northbound lanes and southbound lanes conforming with the ground level lanes 20 and 22 so that the underpass 42 forms an integral part of the north-south road 14.

Similar to the change-direction lane 34 of the east-west road 12, the outer lane 20A of the northbound lanes 20 is provided with a change-direction lane 50 disposed on the ground level to permit right turn traffic, left turn traffic and U-turn traffic to divert away from the outer lane 20A and enter the rotary 24. The outer lane of the southbound lanes 22 is also provided with a change-direction lane 52 to allow right turn traffic, left turn traffic and U-turn traffic to divert away from southbound lanes 22 and enter the rotary 24.

Similar to the merge lanes 38 and 40 of the east-west road 12, the north-south road 14 is provided with merge or outgo lanes 54 and 56 associated, respectively, with the outer lanes of the lanes 20 and 22, to enable traffic having finished right turn, left turn or U-turn on the rotary 24 to get onto the forward run lanes 20 and 22, respectively.

In the illustrated embodiment, a pair of barrier-free pedestrian walkways are provided for respective roads 12 and 14 at grade on the ground level and adjacent the outer periphery of the rotary 24.

Each of the pedestrian walkways 58 for traversing the east-west road 12 includes a pedestrian crossing portion 60 traversing the change-direction lane 34 or 36, a pedestrian crossing portion 62 traversing the merge lane 38 or 40, and an intermediate portion 64 disposed on the ground level to connect the portions 60 and 62 with each other.

As shown, the intermediate portion 64 extends beneath the bridge 28 of the overpass 26 so that pedestrian traffic on the intermediate portion 64 will not be exposed to vehicular traffic traveling through the overpass 26. Traffic control signals may or may not be provided for the crossing portions 60 and 62 to safeguard the pedestrians from vehicular traffic incoming to or outgoing from the rotary 24 through change-direction or merge lanes.

In a similar manner, each of the pedestrian walkways 68 for traversing the north-south road 14 includes a pedestrian crossing portion 70 traversing the change-direction lane 50 or 52, a pedestrian crossing portion 72 traversing the merge lane 54 or 56, and an intermediate portion 74 connecting the portions 70 and 72 together. As the intermediate portion 74 is located on the ground level and extends above the tunnel 44 of the underpass 42, pedestrians on the intermediate portion 74 will be free from exposure to vehicular traffic traveling through the underpass 42.

Advantageously, the crossing portions 60, 62, 70 and 72 as well as the intermediate portion 64 and 74 are all disposed substantially in flush with the neighboring promenade 66. This makes the pedestrian walkways 58 and 68 barrier free and user friendly even for wheeled chairs and baby buggies.

In use, through traffic traveling on the road 12 or 14 may continue to run forward through the overpass 26 or underpass 42.

Right turn traffic, left turn traffic and U-turn traffic will deviate into the change-direction lane 34, 36, 50 or 52 before the overpass 26 or underpass 42, respectively, as viewed in the direction of travel, and after having adequately slowed down and with due attention to the pedestrian traffic and other vehicular traffic, traverse the pedestrian walkways and enter the rotary 24.

The right turn traffic will then turn counterclockwise for some 90 degrees about the center of the rotary 24 and find way to the next merge or outgo lane 38, 40, 54, or 56 to finally merge with the traffic running on a desired forward or straight run lane.

Left turn traffic will turn counterclockwise for roughly 270 degrees about the center of the rotary 24 and outgo through an appropriate merge lane 38, 40, 54, or 56 into an intended forward run lane.

U-turn traffic may turn counterclockwise for nearly 360 degrees around the rotary 24 until it makes a U-turn and outgoes onto a merge lane extending in the direction opposite to the direction of the incoming lane.

Pedestrian traffic, including wheel chairs, is able to traverse the roads 12 and 14 with ease and fairly slowly and relaxed, by traversing the pedestrian walkways 58 and 68 on a bit-by-bit basis and without encountering any serious barriers.

More specifically, to traverse the north-south road 14, for example, it is sufficient for a pedestrian to first traverse only one of the two crossing portions 70 and 72 of the pedestrian walkways 68 to reach the intermediate portion 74. As the length of the crossing portion 70 or 72 is equal to the width of a single road lane, i.e., change-direction or merge lane, and is, therefore, relatively short, it is possible for a pedestrian to traverse one of the crossing portions in a fairly short time and with ease. Upon reaching the intermediate portion 74, the pedestrian may fully slow down or repose therein as long as desired since the intermediate portion 74 is entirely free from vehicular traffic and is safe and tranquil. After possible repose, the pedestrian may further proceed to traverse the remaining crossing portion 72 or 70 to reach the opposite side of the road 12 or 14. Accordingly, the intersection according to the invention is user friendly for elderly, handicapped or infantile pedestrians. Safety of pedestrian traffic is significantly improved because of the presence of the intermediate portion 74 which is not exposed to vehicular traffic. In the case where traffic control signals are provided to control vehicular traffic passing through the change-direction and merge lanes, safety of pedestrian traffic will be enhanced further. As the crossing portions 70 and 72 and the intermediate portion 74 are disposed substantially in flush with the surrounding promenade 66, wheeled chairs, baby buggies and bicycles will not encounter any substantial barrier. The pedestrian walkways 58 for traversing the east-west road 12 provide similar advantages.

Figure 2:
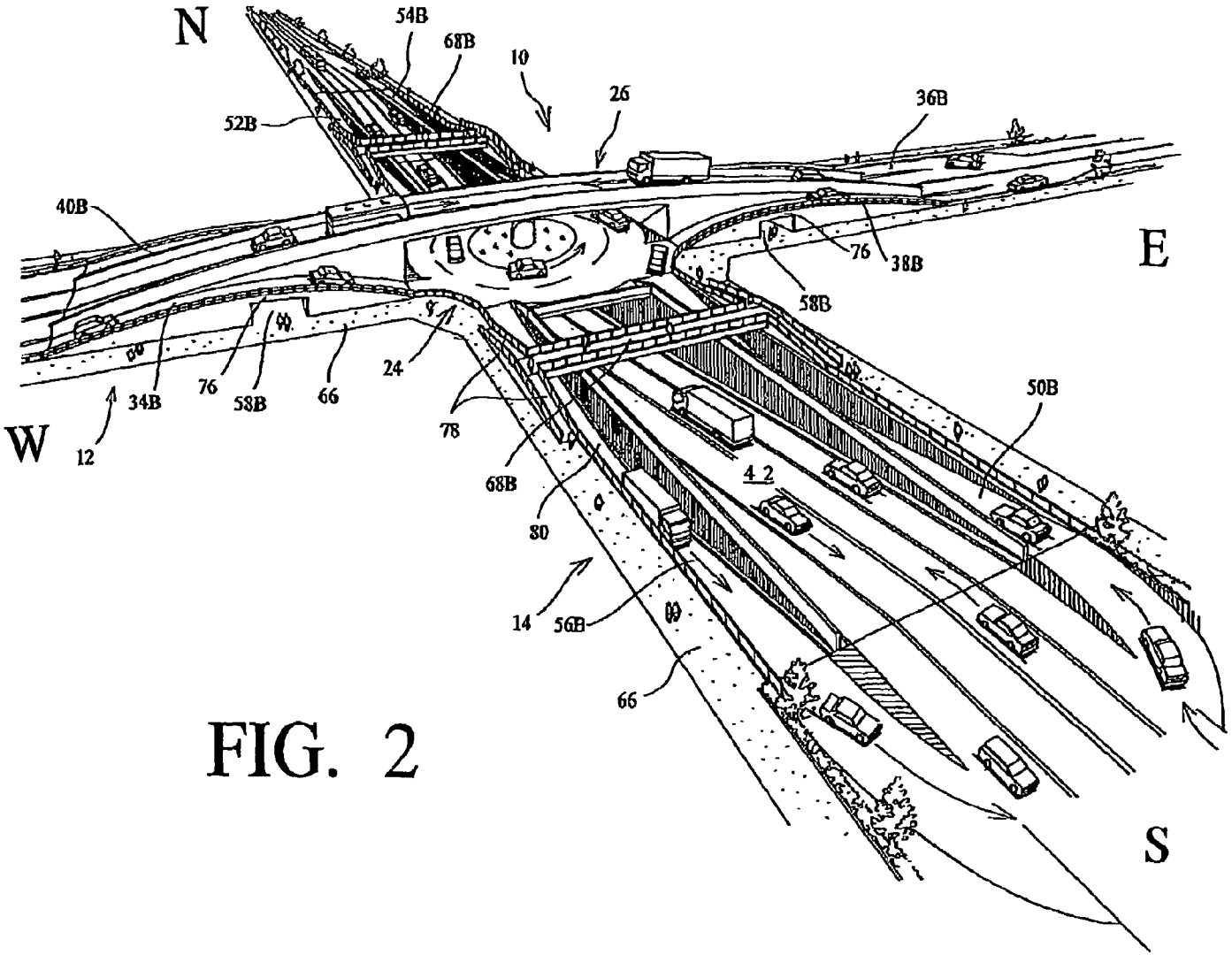
FIG. 2 is a perspective view of the three-level road intersection according to the second embodiment of the invention.

Referring to FIG. 2, there is shown a second embodiment of the invention. This embodiment basically differs from that shown in FIGS. 1A and 1B in that the change-direction and merge lanes are made upwardly convex or downwardly concave to ensure that pedestrian walkways do not intersect at grade with the change-direction and merge lanes so that exposure of pedestrian traffic to vehicular traffic is fully avoided.

In FIG. 2, components and structures similar to those shown in FIGS. 1A and 1B are indicated by like reference numerals and will not be described again. Differing components and structures are designated by like reference numerals with a suffix B. To describe only the differences, the change-direction lanes 34B and 36B and the merge lanes 38B and 40B of the east-west road 12 are made upwardly convex to thereby form raised central portions 76 as compared with the ground level. The pedestrian walkways 58B for traversing the east-west road 12 are made in the form of through tunnels disposed, respectively, on the ground level to pass underneath the overpass 26 and the raised central portions 76 of the change-direction and merge lanes. The pedestrian walkways 58B are joined at both ends with the surrounding promenades 66. With this arrangement, pedestrians are able to traverse the east-west road 12 with ease without being exposed to vehicular traffic.

In contrast, the change-direction lanes 50B and 52B and the merge lanes 54B and 56B of the north-south road 14 are made downwardly concave to thereby form lowered central portions 80 as compared with the ground level. The pedestrian walkways 68B for traversing the north-south road 14 are made in the form of bridges disposed, respectively, at a level slightly higher than the ground level to extend above the underpass 42 and the lowered central portions 80 of the change-direction and merge lanes. The ends of the pedestrian walkways 68B are connected to slanted access passages 78 provided on the promenade 66. The slope of the access passages 78 is so limited as to ensure access by wheeled chairs to the pedestrian walkways 68B. The pedestrian walkways 68B in the form of pedestrian bridge will similarly enable pedestrians to traverse the north-south road 14 with ease and without being exposed to vehicular traffic. Positioning the pedestrian bridges 68B at a level slightly higher than the ground level is advantageous in that the maximum depth of the lowered central portions 80 of the concave change-direction lanes 50B and 52B and the merge lanes 54B and 56B is, in turn, limited.

Figure 3:
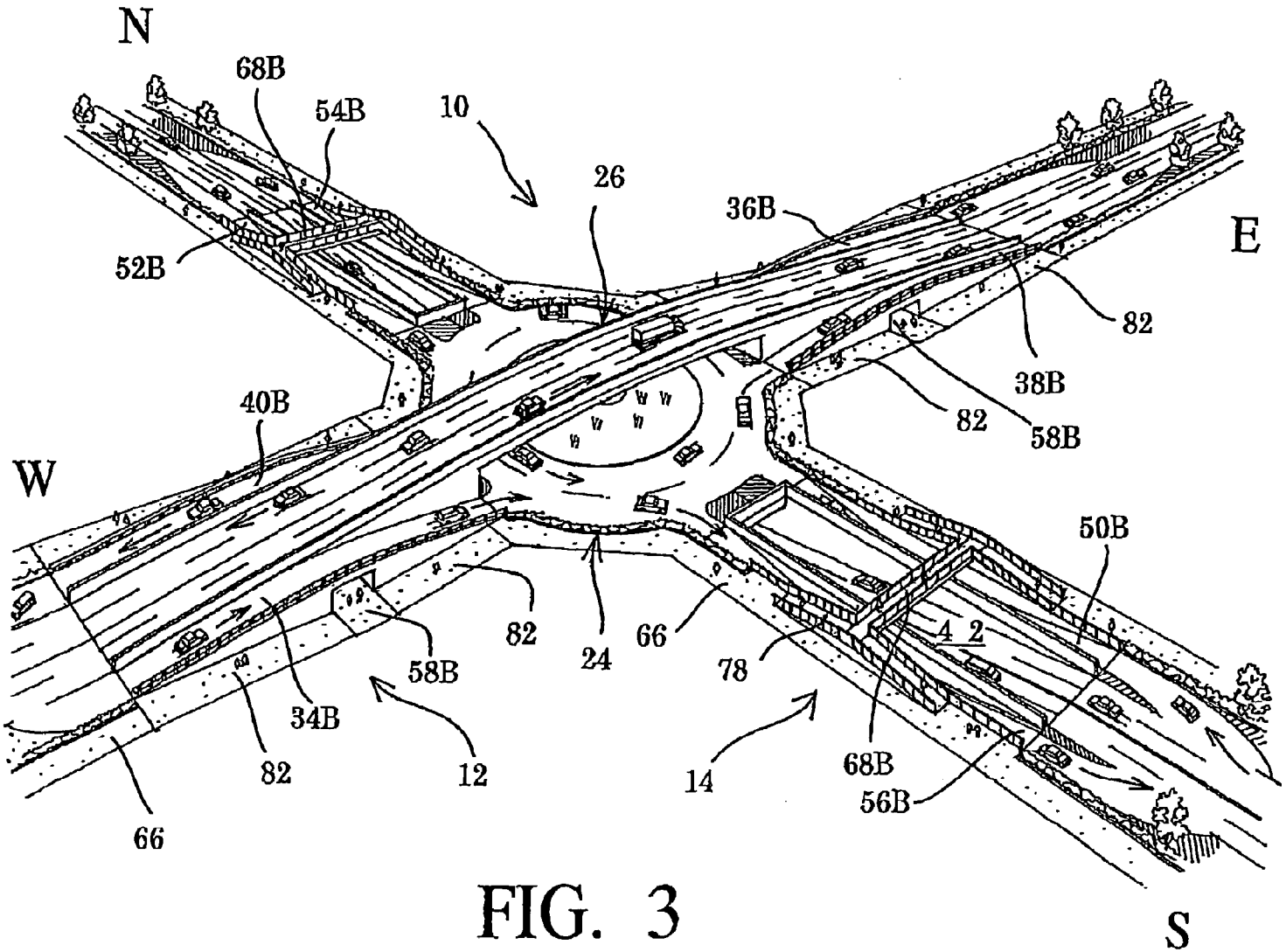
FIG. 3 is a perspective view of a modified form of the intersection shown in FIG. 2.

FIG. 3 illustrates a modified form of the intersection shown in FIG. 2. This modified form differs from that shown in FIG. 2 only in that the level of the pedestrian walkways for traversing the east-west road 12 is slightly lowered. Therefore, in FIG. 2, components and structures similar to those shown in FIG. 2 are indicated by like reference numerals and need not be described again. To describe only the differences, the pedestrian walkways 58B traversing the east-west road 12 are disposed at a level slightly lower than the ground level. This advantageously enables to limit the maximum height, from the ground level, of the raised central portions of the change-direction and merge lanes of the east-west road 12 to thereby make the inclination of the change-direction and merge lanes less steeply. To ensure access to the pedestrian walkways 58B provided on the sub-ground level, slanted access passages 82 are formed on the promenade 66.

Figure 4:
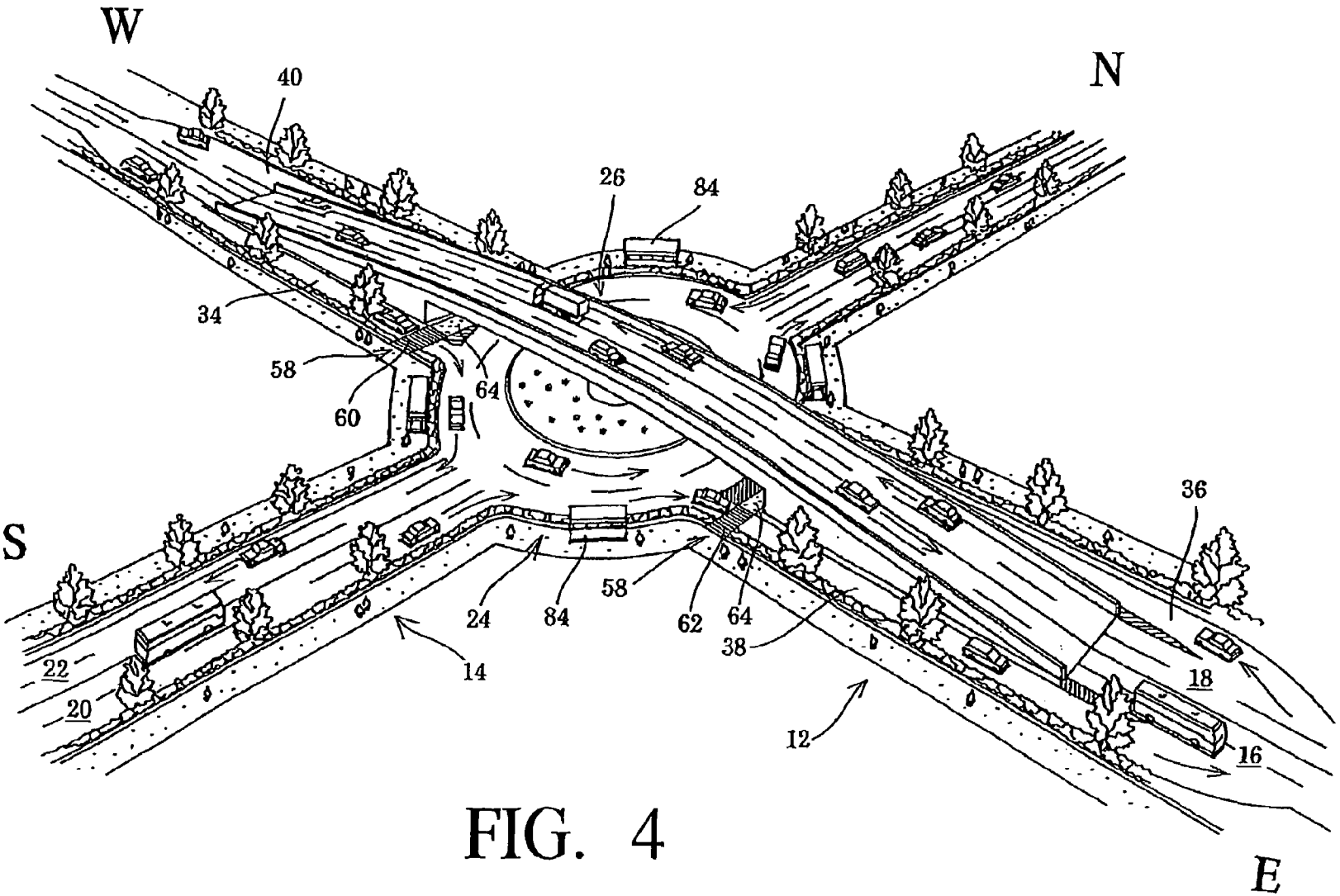
FIG. 4 is a perspective view of a two-level intersection according to a simplified form of the invention; and, FIG. 5 is a perspective view of a modified form of the intersection shown in FIG. 4.

FIG. 4 shows a simplified form of the road intersection shown in FIGS. 1A and 1B. In FIG. 4, components and structures similar to those shown in FIGS. 1A and 1B are indicated by like reference numerals and will not be described again. Feature of this simplified form of the invention is that the underpass 42 shown in FIGS. 1A and 1B is omitted so that all the lanes of the north-south road 14 is connected to the rotary 24. Therefore, the intersection is of the two level. Similar to the intersection shown in FIGS. 1A and 1B, pedestrian walkways 58 for traversing the east-west road 12 are provided. Pedestrian walkways, not shown, for traversing the north-south road 14 are made in the form of underground tunnels, with entrance and exit facilities 84 provided on the ground level.

In another simplified form of the intersection, not shown, the overpass 26 shown in FIG. 4 is replaced by an underpass which is similar to the underpass 42 shown in FIGS. 1A and 1B. Illustration of this simplified form will not be necessary since it will be apparent from FIG. 4 for those skilled in the art.

Figure 5:
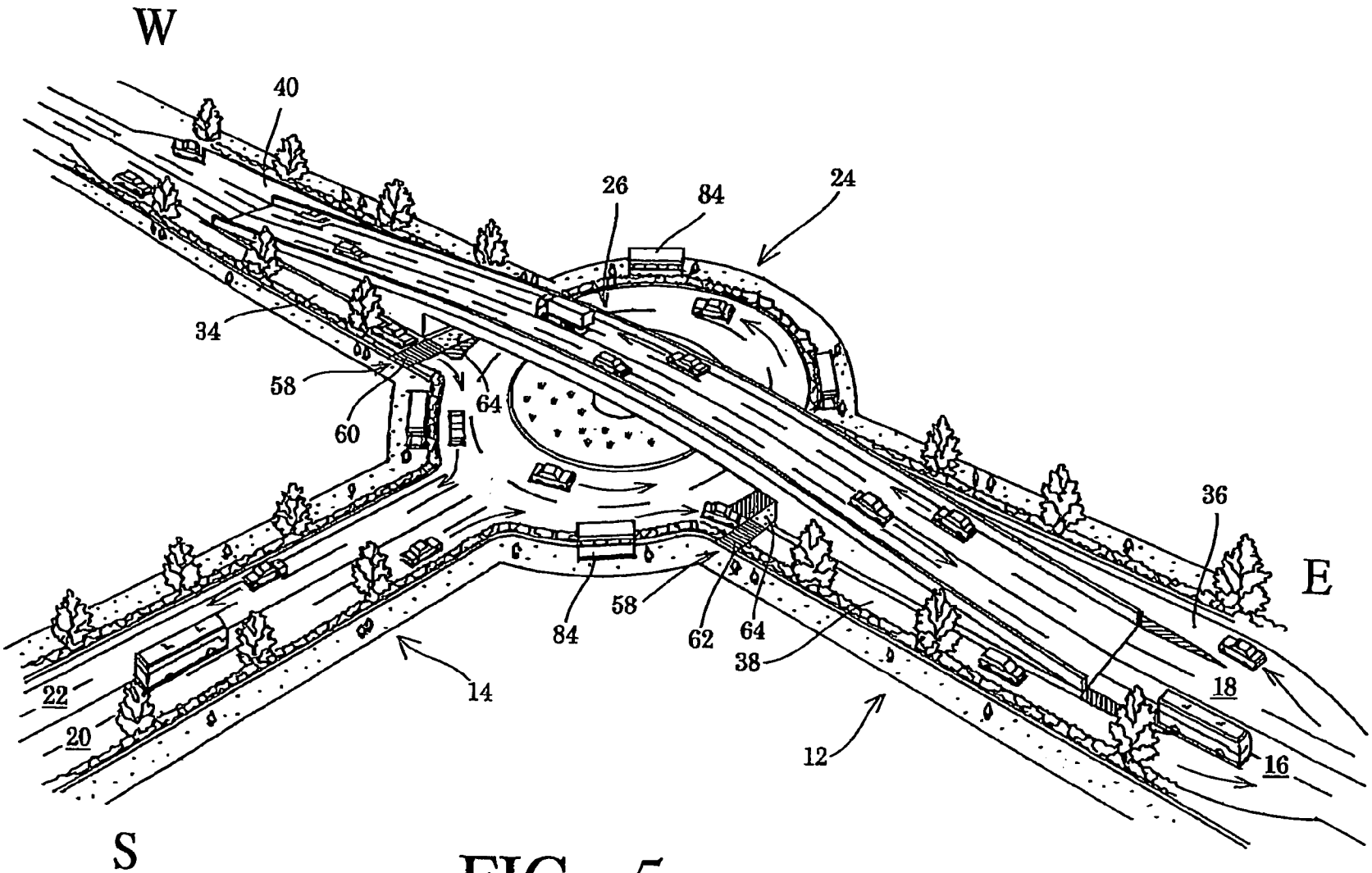

FIG. 5 illustrates a modified simplified form of the road intersection shown in FIG. 4. In FIG. 5, also, components and structures similar to those shown in FIG. 4 are indicated by like reference numerals. Feature of this modified simplified form as compared with that shown in FIG. 4 is that the two-level road intersection is T-shaped, with the northern end of the west-bound road 14 is joined in T to the rotary 24. Pedestrian walkways 58 for traversing the east-west road 12 are provided in a manner similar to the foregoing embodiments.

In a still another simplified form of the invention, not shown, the overpass 26 shown in FIG. 5 may be replaced by an underpass which is similar to the underpass 42 shown in FIGS. 1A and 1B.

While the present invention has been described herein with reference to the specific embodiments thereof, it is contemplated that the invention is not limited thereby and various modifications and alterations may be made therein without departing from the scope of the invention. For example, the intersection and roads may be provided with traffic control signals, guard rails, lighting facilities, and drainage systems. The number of lanes may be reduced or increased.

What is claimed is:

1. A three-level road intersection, comprising:

a first road extending in a first direction and having opposite travel lanes;

a second road extending in a second direction intersecting said first direction and having opposite travel lanes, said first and second roads being disposed at ground level on opposing sides of an intersection where said first and second roads cross;

a rotary disposed at the ground level within said intersection for handling right turn, left turn and U-turn traffic;

a continuous-flow overpass, forming part of said first road and elevated to extend over said rotary for a distance greater than the outer diameter of said rotary, for handling through traffic traveling on said first road;

a continuous-flow underpass, forming part of said second road and extending underneath said rotary for a distance greater than the outer diameter of said rotary, for handling through traffic traveling on said second road;

change-direction lanes disposed on the ground level contiguous to said rotary and alongside of said roads, including one change-direction lane associated with each of said travel lanes approaching the overpass or underpass, each of said change-direction lanes separating at one end thereof from its associated travel lane approaching the overpass or underpass, to divert right turn, left turn and U-turn traffic away from its associated travel lane, each of said change-direction lanes being merged at its other end with said rotary to enable right turn, left turn and U-turn traffic to enter into said rotary;

merge lanes disposed on the ground level contiguous to said rotary and alongside of said roads, including one merge lane associated with each of said travel lanes departing the overpass or underpass, each of said merge lanes being connected at one end thereof to said rotary and merging at its other end with its associated travel lane beyond the overpass or underpass to enable traffic to enter into an intended travel lane after completion of a right turn, left turn or U-turn; and, at least one barrier-free pedestrian walkway extending traversely of one of said first and second roads and disposed on grade at the ground level, outwardly of and adjacent to an outer periphery of said rotary, to enable pedestrians to traverse said one of said first and second roads and associated change-direction and merge lanes, without exposure to through traffic traveling said continuous-flow overpass or underpass.

2. A road intersection as defined in claim 1, wherein said pedestrian walkway comprises pedestrian crossing portions which traverse at grade said change-direction lane and associated merge lane, respectively, of said first road and an intermediate portion disposed on the ground level to pass underneath said overpass to connect said crossing portions with each other.

3. A road intersection as defined in claim 1, wherein said pedestrian walkway comprises pedestrian crossing portions which traverse at grade said change-direction lane and associated merge lane, respectively, of said second road and an intermediate portion disposed on the ground level to extend over said underpass to connect said crossing portions with each other.

4. A road intersection as defined in claim 2, wherein said first road further comprises one or more lanes disposed between said opposite lanes of said first road.

5. A road intersection as defined in claim 3, wherein said second road further comprises one or more lanes disposed between said opposite lanes of said second road.

6. A three-level road intersection, with a barrier-free pedestrian walkway, said intersection comprising:

a first road extending in a first direction and having opposite travel lanes;

a second road extending in a second direction intersecting said first direction and having opposite travel lanes, said first and second roads being disposed at ground level on opposing sides of an intersection where said first and second roads cross;

a rotary disposed at the ground level within said intersection for handling right turn, left turn and U-turn traffic;

a continuous-flow overpass, forming part of said first road and elevated to extend over said rotary for a distance greater than the outer diameter of said rotary, for handling through traffic traveling on said first road;

a continuous-flow underpass, forming part of said second road and extending underneath said rotary for a distance greater than the outer diameter of said rotary, for handling through traffic traveling on said second road;

change-direction lanes contiguous to said rotary and alongside of said roads, including one change-direction lane associated with each of said travel lanes approaching the overpass or underpass, each of said change-direction lanes separating at one end thereof from its associated travel lane approaching the overpass or underpass, to divert right turn, left turn and U-turn traffic away from its associated travel lane, each of said change-direction lanes being merged at its other end with said rotary to enable right turn, left turn and U-turn traffic to enter into said rotary, at least one of said change-direction lanes of said first road being upwardly convex to form a raised central portion;

merge lanes contiguous to said rotary and alongside of said roads, including one merge lane associated with each of said travel lanes, each of said merge lanes being connected at one end thereof to said rotary and merging at its other end with its associated travel lane beyond the overpass or underpass to enable traffic to enter into an intended travel lane after completion of a right turn, left turn or U-turn, at least one of said merge lanes of said first road, corresponding to said at least one of said change-direction lanes of said first road, being upwardly convex to form a raised central portion; and, a barrier-free pedestrian walkway extending traversely to said first road and disposed on grade at the ground level to enable pedestrians to traverse said first road, said at least one change-direction lane and said at least one merge lane, said pedestrian walkway extending underneath said overpass and said raised central portions of said change-direction and merge lanes, thereby protecting pedestrians from exposure to through traffic traveling on said first road and from exposure to traffic on said at least one change-direction lane and said at least one merge lane.

7. A three-level road intersection, with barrier-free pedestrian walkway, said intersection comprising:

a first road extending in a first direction and having opposite travel lanes;

a second road extending in a second direction intersecting said first direction and having opposite travel lanes, said first and second roads being disposed at ground level on opposing sides of an intersection where said first and second roads cross;

a rotary disposed at the ground level within said intersection for handling right turn, left turn and U-turn traffic;

a continuous-flow overpass, forming part of said first road and elevated to extend over said rotary for a distance greater than the outer diameter of said rotary, for handling through traffic traveling on said first road;

a continuous-flow underpass, forming part of said second road and extending underneath said rotary for a distance greater than the outer diameter of said rotary, for handling through traffic traveling on said second road;

change-direction lanes contiguous to said rotary and alongside of said roads, including one change-direction lane associated with each of said travel lanes, each of said change-direction lanes separating at one end thereof from its associated travel lane approaching the overpass or underpass, to divert right turn, left turn and U-turn traffic away from its associated travel lane, each of said change-direction lanes being merged at its other end with said rotary to enable right turn, left turn and U-turn traffic to enter into said rotary, at least one of said change-direction lanes of said first road being upwardly convex to form a raised central portion;

merge lanes contiguous to said rotary and alongside of said roads, including one merging lane associated with each of each of said travel lanes, each of said merge lanes being connected at one end thereof to said rotary and being merged at its other end with its associated travel lane at a point beyond the overpass or underpass to enable traffic to enter into an intended travel lane after completion of a right turn, left turn or U-turn, at least one of said merge lanes of said first road, corresponding to said at least one of said change-direction lanes of said first road, being upwardly convex to form a raised central portion;

a barrier-free pedestrian walkway traversing said first road, said at least one change-direction lane and said at least one merge lane, said pedestrian walkway being disposed at a level lower than the ground level and extending underneath said overpass and said raised central portions of said change-direction and merge lanes, thereby protecting pedestrians from exposure to through traffic traveling on said first road and from exposure to traffic on said at least one change-direction lane and said at least one merge lane; and, slanted access passages provided between ground level and said pedestrian walkway to permit access by wheel chair to said pedestrian walkway.

8. A three-level road intersection, with barrier-free pedestrian walkway, said intersection comprising:

a first road extending in a first direction and having opposite travel lanes;

a second road extending in a second direction intersecting said first direction and having opposite travel lanes, said first and second roads being disposed at ground level on opposing sides of an intersection where said first and second roads cross;

a rotary disposed at the ground level within said intersection for handling right turn, left turn and U-turn traffic;

a continuous-flow overpass, forming part of said first road and elevated to extend over said rotary for a distance greater than the outer diameter of said rotary, for handling through traffic traveling on said first road;

a continuous-flow underpass, forming part of said second road and extending underneath said rotary for a distance greater than the outer diameter of said rotary, for handling through traffic traveling on said second road;

change-direction lanes contiguous to said rotary and alongside of said roads, including one change-direction lane associated with each of said travel lanes, each of said change-direction lanes separating at one end thereof from its associated travel lane approaching the overpass or underpass, to divert right turn, left turn and U-turn traffic away from its associated travel lane, each of said change-direction lanes being merged at its other end with said rotary to enable right turn, left turn and U-turn traffic to enter into said rotary, at least one of said change-direction lanes of said second road being downwardly concave to form a lowered central portion;

merge lanes contiguous to said rotary and alongside of said roads, including one merging lane associated with each of each of said travel lanes, each of said merge lanes being connected at one end thereof to said rotary and being merged at its other end with its associated travel lane at a point beyond the overpass or underpass to enable traffic to enter into an intended travel lane after completion of a right turn, left turn or U-turn, at least one of said merge lanes of said second road, corresponding to said at least one of said change-direction lanes of said second road, being downwardly concave to form a lowered central portion;

a barrier-free pedestrian walkway traversing said second road, said at least one change-direction lane and said at least one merge lane, said pedestrian walkway being in the form of a bridge disposed at a level higher than the ground level and extending above said underpass and said lowered central portions of said change-direction and merge lanes, thereby protecting pedestrians from exposure to through traffic traveling on said first road and from exposure to traffic on said at least one change-direction lane and said at least one merge lane; and, slanted access passages provided between ground level and said pedestrian walkway to permit access by wheel chair to said pedestrian walkway.

9. A three-level road intersection, comprising:

a first road extending in a first direction and having opposite travel lanes;

a second road extending in a second direction intersecting said first direction and having opposite travel lanes, said first and second roads being disposed at ground level on opposing sides of an intersection where said first and second roads cross;

a rotary disposed at the ground level within said intersection for handling right turn, left turn and U-turn traffic;

an overpass interposed in said first road to form part thereof and elevated to extend over said rotary, for handling through traffic traveling on said first road;

an underpass interposed in said second road to form part thereof and extending beneath said rotary for handling through traffic traveling on said second road;

change-direction lanes disposed at the ground level contiguous to said rotary and alongside of said roads, including one change-direction lane associated with each of said travel lanes approaching the overpass or underpass, each of said change-direction lanes separating at one end thereof from its associated travel lane approaching the overpass or underpass and for enabling said traffic to enter into said rotary for a right turn, left turn or U-turn; and, merge lanes disposed at the ground level, including one merge lane associated with each of said travel lanes for allowing traffic on said rotary to enter into an intended travel lane after completion of a right turn, left turn or U-turn; and, barrier-free pedestrian walkways extending traversely to said first and second roads, respectively, and disposed on grade at the ground level outwardly of and adjacent to an outer periphery of said rotary to enable pedestrians to traverse said first and second roads and associated change-direction and merge lanes, each of said pedestrian walkways comprising pedestrian crossing portions which traverse on grade said associated change-direction lane and said associated merge lane, respectively, of said first or second road and an intermediate portion disposed at ground level, passing underneath said overpass or over said underpass and connecting said crossing portions with each other, said intermediate portion enabling pedestrians to traverse said first and second roads without exposure to through traffic on said first and second roads.

10. A road intersection as defined in claim 1 wherein said at least one barrier-free pedestrian walkway includes a portion which is contoured to curve around a portion of said rotary.

11. A road intersection as defined in claim 7 wherein said at least one barrier-free pedestrian walkway includes a portion which is contoured to curve around a portion of said rotary.

12. A road intersection as defined in claim 9 wherein said at least one barrier-free pedestrian walkway includes a portion which is contoured to curve around a portion of said rotary.

* * * * *